US009995053B2

(12) United States Patent
Ono et al.

(10) Patent No.: US 9,995,053 B2
(45) Date of Patent: Jun. 12, 2018

(54) DETECTION METHOD FOR COLLISION OF A FLYING OBJECT AGAINST AN ARCHITECTURAL STRUCTURE, DETECTION APPARATUS FOR COLLISION OF A FLYING OBJECT AGAINST AN ARCHITECTURAL STRUCTURE, AND FACILITY FOR CLOSING AN OPENING OF AN ARCHITECTURAL STRUCTURE

(71) Applicant: KABUSHIKI KAISHA TOSHIBA, Minato-Ku (JP)

(72) Inventors: Masayuki Ono, Nerima (JP); Yoshihiro Shoji, Yokohama (JP); Tetsuharu Tanoue, Meguro (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days. days.

(21) Appl. No.: 15/525,416

(22) PCT Filed: Nov. 13, 2015

(86) PCT No.: PCT/JP2015/081981
§ 371 (c)(1),
(2) Date: May 9, 2017

(87) PCT Pub. No.: WO2016/076418
PCT Pub. Date: May 19, 2016

(65) Prior Publication Data

US 2017/0337799 A1 Nov. 23, 2017

(30) Foreign Application Priority Data

Nov. 14, 2014 (JP) ..... 2014-231301

(51) Int. Cl.
*G08G 5/04* (2006.01)
*E04H 9/04* (2006.01)
*E04H 9/06* (2006.01)

(52) U.S. Cl.
CPC ..... *E04H 9/04* (2013.01); *E04H 9/06* (2013.01); *G08G 5/04* (2013.01)

(58) Field of Classification Search
CPC ..... H05B 37/0027; H05B 37/0236; G01P 15/125; G01P 2015/0831; G08G 5/04;
(Continued)

(56) References Cited

U.S. PATENT DOCUMENTS 5,488,864 A * 2/1996 Stephan ..... G01P 15/125 73/514.32
9,747,809 B2 * 8/2017 Levien ..... G08G 5/04
(Continued)

FOREIGN PATENT DOCUMENTS

JP 2004-003241 A 1/2004
JP 2005-188819 A 7/2005
(Continued)

OTHER PUBLICATIONS

English Translation of the International Preliminary Report on Patentability dated May 16, 2017 for International Application No. PCT/JP2015/081981.
(Continued)

*Primary Examiner* — Van Trieu
(74) *Attorney, Agent, or Firm* — Oblon, McClelland, Maier & Neustadt, L.L.P.

(57) ABSTRACT

A detection apparatus includes: a plurality of accelerometers configured to be installed on respective positions of the architectural structure which are different in height from each other and separately measure an acceleration value generated in the architectural structure; and a computer
(Continued)

configured to perform computation by using acceleration values measured by the plurality of accelerometers and detect collision of a flying object (airplane) against the architectural structure when a ratio between the acceleration values measured by the plurality of accelerometers exceeds a first threshold value.

15 Claims, 3 Drawing Sheets

(58) Field of Classification Search
CPC ..... G08G 5/045; G08D 1/00; G08D 1/0088; E04H 9/02; E04H 9/04; E04H 9/06; E04H 9/08
See application file for complete search history.

(56) References Cited

U.S. PATENT DOCUMENTS

| | | | |
|---|---|---|---|
| 2009/0275279 | A1 | 11/2009 | Holt et al. |
| 2014/0229020 | A1 | 8/2014 | Miyajima et al. |

FOREIGN PATENT DOCUMENTS

| | | | |
|---|---|---|---|
| JP | 2010-261264 | A | 11/2010 |
| JP | 2011-523009 | A | 8/2011 |
| JP | 2014-152592 | A | 8/2014 |
| JP | 2015-200124 | A | 11/2015 |

OTHER PUBLICATIONS

International Search Report dated Feb. 2, 2016 in PCT/JP2015/081981, filed Nov. 13, 2015.

* cited by examiner

DETECTION METHOD FOR COLLISION OF A FLYING OBJECT AGAINST AN ARCHITECTURAL STRUCTURE, DETECTION APPARATUS FOR COLLISION OF A FLYING OBJECT AGAINST AN ARCHITECTURAL STRUCTURE, AND FACILITY FOR CLOSING AN OPENING OF AN ARCHITECTURAL STRUCTURE

TECHNICAL FIELD

Embodiments of the present invention relate to a detection method and a detection apparatus for collision of a flying object (e.g., an airplane) against an architectural structure such as a nuclear reactor building, and also relate to a facility for closing an opening of an architectural structure which is equipped with the above-described detection apparatus.

BACKGROUND ART

In an advanced boiling water reactor (ABWR), it is required to protect a nuclear reactor building from collision of a flying object such as an airplane by various regulations such as IAEA, 10 CFR, Regulatory Guide, European regulations (e.g., YVL Guides in Finland). Thus, it is considered as a structure for an ABWR to protect internal facilities from load, flame, and blast at the time of collision of a flying object by ruggedizing an exterior wall and a roof of its architectural structure.

Additionally, it is considered as a countermeasure for collision to install a physical block such as a protection door on an opening of the architectural structure. However, the opening is equipped with HVAC (Heating Ventilation and Air-Conditioning) and is needed to be opened on a steady basis in terms of its functional requirement. Thus, it is difficult to provide the opening with a physical block such as a protection door as a countermeasure for collision. For this reason, it is required for the opening equipped with HVAC to detect collision of a flying object and to be closed before flame and blast generated by the collision of the flying object invade inside of the architectural structure through this opening.

As an assumed colliding object aside from the above-described airplane, there is a flying object containing fuel such as a missile, a rocket, a helicopter, an airship, and a flying balloon.

Meanwhile, the Patent Document 1 discloses a countermeasure for airplane collision against an architectural structure. In the invention disclosed in the Patent Document 1, a floor drain ditch is installed on each aboveground ordinary floor of a superhigh-rise architectural structure in a manner similar to a floor drain ditch in its roof and is connected via pipes to a liquid vessel provided underground or outside. This floor drain ditch rapidly flows aircraft fuel, which has leaked from the colliding airplane and invaded inside of this architectural structure, downward from the collision floor to the liquid vessel.

Additionally, the Patent Document 2 discloses a configuration of enhancing aseismic performance of an architectural structure by causing an opening/closing plate of an opening of this architectural structure to close this opening and be fixed to this architectural structure when seismic vibration exceeds a predetermined threshold value.

Further, the Patent Document 3 and the Patent Document 4 disclose an invention of controlling ventilation inside an architectural structure on the basis of a detection value inputted from a temperature sensor or a pressure sensor.

PRIOR ART DOCUMENT

Patent Document

[Patent Document 1] Japanese Unexamined Patent Application Publication No. 2004-3241

[Patent Document 2] Japanese Unexamined Patent Application Publication No. 2010-261264

[Patent Document 3] Japanese Unexamined Patent Application Publication No. 2005-188819

[Patent Document 4] Japanese Unexamined Patent Application Publication (Translation of PCT Application) No. 2011-523009

DESCRIPTION OF INVENTION

Problems to be Solved by Invention

The above-described invention disclosed in the Patent Document 1 is a countermeasure for collision of an airplane against an architectural structure by preventing the architectural structure from collapsing. However, the invention disclosed in the Patent Document 1 is neither configuration of detecting collision of an airplane against the architectural structure nor configuration of preventing flame and blast caused by airplane collision from invading inside of the architectural structure through its opening.

In view of the above-described problems, it is an aim of embodiments of the present invention to provide a detection method and a detection apparatus for collision of a flying object against an architectural structure, which detection method/apparatus can reliably detect collision of a flying object such as an airplane against an architectural structure.

Additionally, it is another aim of embodiments of the present invention to provide a facility for closing an opening of an architectural structure, which facility can prevent flame and blast caused by collision of a flying object from invading inside of the architectural structure through the opening.

Means for Solving Problem

In one embodiment of the present invention, a detection method for collision of a flying object against an architectural structure includes steps of: installing a plurality of accelerometers on respective positions of the architectural structure which are different in height from each other;

causing each of the plurality of accelerometers to measure an acceleration value generated in the architectural structure; and detecting collision of the flying object against the architectural structure when a ratio between the measured acceleration values exceeds a first threshold value.

Additionally, in another embodiment of the present invention, a detection apparatus for collision of a flying object includes: a plurality of accelerometers configured to be installed on respective positions of an architectural structure which are different in height from each other and to separately measure an acceleration value generated in the architectural structure; and a computer configured to be electrically connected to the plurality of accelerometers, perform computation by using acceleration values measured by the plurality of accelerometers, and detect collision of a flying object against the architectural structure when a ratio between the acceleration values measured by the plurality of accelerometers exceeds a first threshold value.

Moreover, in still another embodiment of the present invention, a facility for closing at least one of plural openings of an architectural structure includes: a closing apparatus configured to close at least one of plural openings; and a collision detection apparatus, wherein the detection apparatus includes a computer configured to cause the closing apparatus to close at least one of plural openings when the computer detects collision of a colliding object.

Further, in still another embodiment of the present invention, a facility for closing at least one of plural openings of an architectural structure includes: a closing apparatus configured to close at least one of plural openings; and a collision detection apparatus configured to detect collision of a colliding object against the architectural structure, wherein the collision detection apparatus includes a computer configured to cause the closing apparatus to close at least one of plural openings when the computer detects collision of the colliding object.

Furthermore, in still another embodiment of the present invention, a facility for closing at least one of plural openings of an architectural structure includes: a closing apparatus configured to close at least one of plural openings; and a collision detection apparatus configured to detect collision of a colliding object against the architectural structure, wherein the collision detection apparatus includes a computer configured to cause the closing apparatus to close an opening existing in a collision direction of the colliding object when the computer detects the collision direction of the colliding object.

Additionally, in still another embodiment of the present invention, a facility for closing at least one of plural openings of an architectural structure includes: a closing apparatus configured to close at least one of plural openings; and a collision detection apparatus configured to detect collision of a colliding object against the architectural structure, wherein the collision detection apparatus includes a computer configured to cause the closing apparatus to close an opening existing at a collision position of the colliding object when the computer detects the collision position of the colliding object.

Effect of Invention

According to a detection method and a detection apparatus for collision of a flying object against an architectural structure in embodiments of the present invention, it is possible to reliably detect collision of an airplane against an architectural structure.

Additionally, according to a facility for closing an opening of an architectural structure in embodiments of the present invention, it is possible to prevent flame and blast caused by collision of a flying object from invading inside of the architectural structure through the opening.

MODES FOR EMBODYING INVENTION

Hereinafter, embodiments of the present invention will be described with reference to the accompanying drawings.

Although a description will be given of a case where a flying object (i.e., collision object) is an airplane, the application range of embodiments of the present invention is not limited to an airplane but includes other flying objects.

[First Embodiment (FIG. 1, FIG. 2)]

Figure 1:
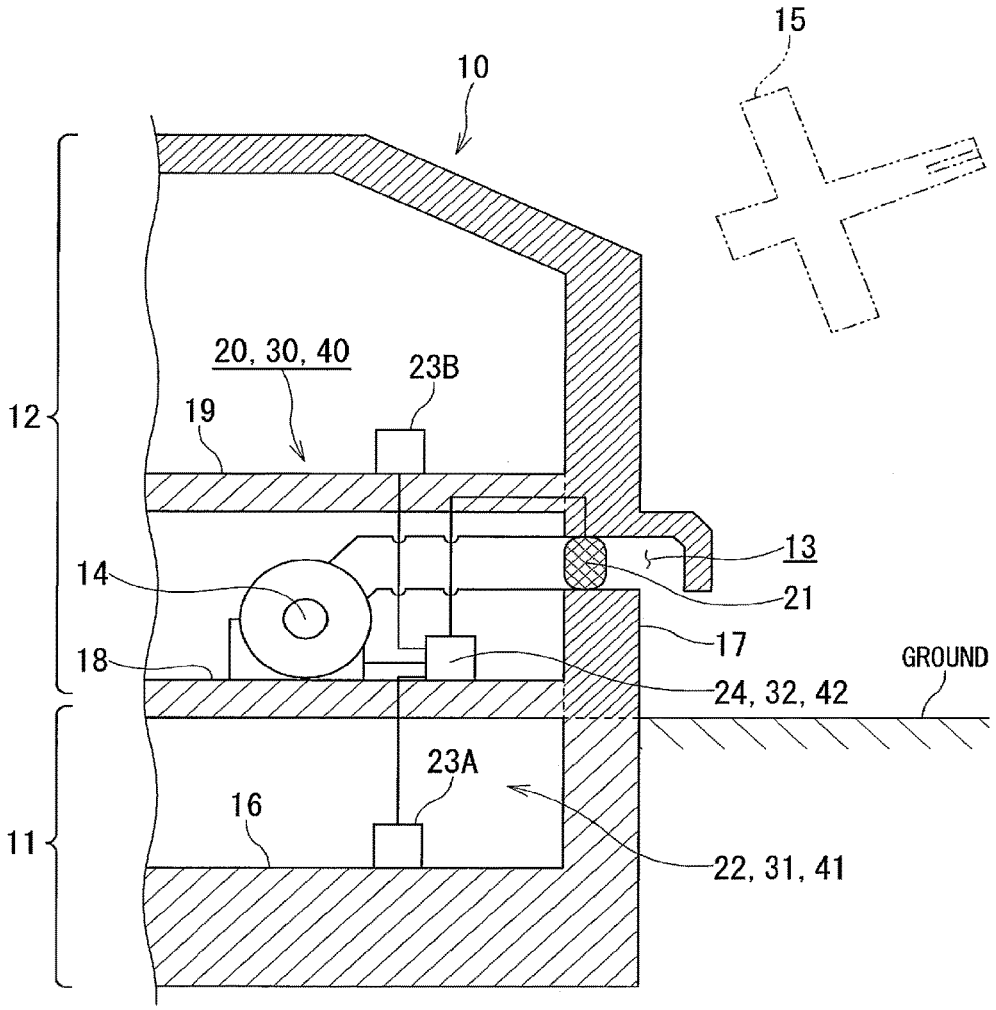
FIG. 1 is a general configuration diagram illustrating the main part of a facility for closing an opening of an architectural structure in each of the first to third embodiments together with this architectural structure.

FIG. 1 is a configuration diagram illustrating a facility for closing an opening of an architectural structure in each of the first to third embodiments together with this architectural structure. The architectural structure (e.g., nuclear reactor building) 10 shown in FIG. 1 includes one or plural basement floor 11 and plural aboveground floors 12. Plural openings 13 are formed in the aboveground floors 12 in such a manner that the inside and outside of the architectural structure 10 are spatially connected with each other by each of the openings 13. HVAC (Heating Ventilation and Air-Conditioning) systems 14 are installed on inside of the architectural structure 10 in association with the respective openings 13. One of the openings 13 is formed at, e.g., a wall of the first floor of the aboveground floor 12, and the HVAC system 14 is installed on, e.g., a first-story floor 18.

The above-described architectural structure 10 is equipped with a closing facility 20 as a facility for closing an opening of an architectural structure. This closing facility 20 includes closing apparatuses 21 configured to screen (i.e., close) respective opening 13 as a blocking means, and further includes an airplane-collision detecting apparatus 22 configured to detect collision of an airplane 15 against the architectural structure 10 as a detection apparatus for collision of an airplane against an architectural structure. Each closing apparatus 21 is, e.g., a shutter or a door.

The airplane-collision detecting apparatus 22 includes plural accelerometers (e.g., seismographs) 23A, 23B, . . . and a computer 24 as a computation means. The respective accelerometers 23A, 23B, . . . are installed on positions which are different in height from each other, and measure acceleration generated in the architectural structure 10. The computer 24 stores acceleration values measured by the respective accelerometer 23A, 23B, . . . and performs computation by using those acceleration values.

The accelerometer 23A, 23B, . . . measure, as acceleration, vibration generated in the architectural structure 10 due to, e.g., an earthquake, wind, collision of the airplane 15 against the architectural structure 10.

Figure 2:
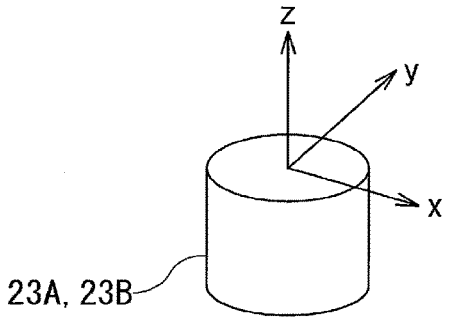
FIG. 2 is a schematic perspective view illustrating an accelerometer installed on the architectural structure shown in FIG. 1.

In the first embodiment, the accelerometer 23A is installed on, e.g., a basement 16 on the basement floor 11 of the architectural structure 10, and measures vibration of this basement 16 as acceleration. Additionally, the accelerometer 23B is installed on, e.g., a second-story floor 19 of the aboveground floor 12 of the architectural structure 10, and measures vibration of the second-story floor 19 as acceleration. As shown in FIG. 2, those accelerometers 23A, 23B, . . . can measure acceleration components in the two horizontal directions (i.e., the x-direction and the y-direction) and an acceleration component in one vertical direction (i.e., the z-direction).

The computer 24 is installed on, e.g., the first-story floor 18 of the aboveground floor 12 of the architectural structure 10, is electrically connected to the accelerometers 23A, 23B, . . . , and is electrically connected to the closing apparatus 21 and the HVAC system 14. The computer 24 detects collision of the airplane 15 against the architectural structure 10, when a ratio between acceleration values measured by the respective accelerometers 23A, 23B, . . . exceeds the first threshold value and at least one of the acceleration values measured by the respective accelerometers 23A, 23B, . . . exceeds the second threshold value as described below. Here, the above-described ratio between acceleration values means, e.g., a ratio of the acceleration value measured by the accelerometer 23B to the acceleration value measured by the accelerometer 23A.

In the case of an earthquake, an acceleration value sometimes exceeds the second threshold value depending on the type of the architectural structure 10 but the ratio between acceleration values never exceeds the first threshold value.

Additionally, in the case of wind, the ratio between acceleration values sometimes exceeds the first threshold value depending on the type of the architectural structure 10 but an acceleration value never exceeds the second threshold value.

Thus, it is possible to accurately detect collision of the airplane 15 against the architectural structure 10 by determining a case where the ratio between acceleration values exceeds the first threshold value and at least one acceleration value exceeds the second threshold value.

The above-described first threshold value is a value which satisfies the condition that the ratio between acceleration values generated in the architectural structure 10 does not exceed the first threshold value in the case of an earthquake but exceeds the first threshold value in the case of wind.

Additionally, the second threshold value is a value which satisfies the condition that any of the measured acceleration values does not exceed the second threshold value in the case of wind but exceeds the second threshold value in the case of an earthquake.

The computer 24 transmits an operation command to all the closing apparatuses 21 installed on the architectural structure 10 and causes the closing apparatuses 21 to operate such that all the openings 13 of the architectural structure 10 are closed, when detecting collision of the airplane 15 against the architectural structure 10. At the same time, the computer 24 transmits a stop command to all the HVAC systems 14 installed in association with the respective openings 13 to be closed so as to stop all the HVAC systems 14.

Figure 3:
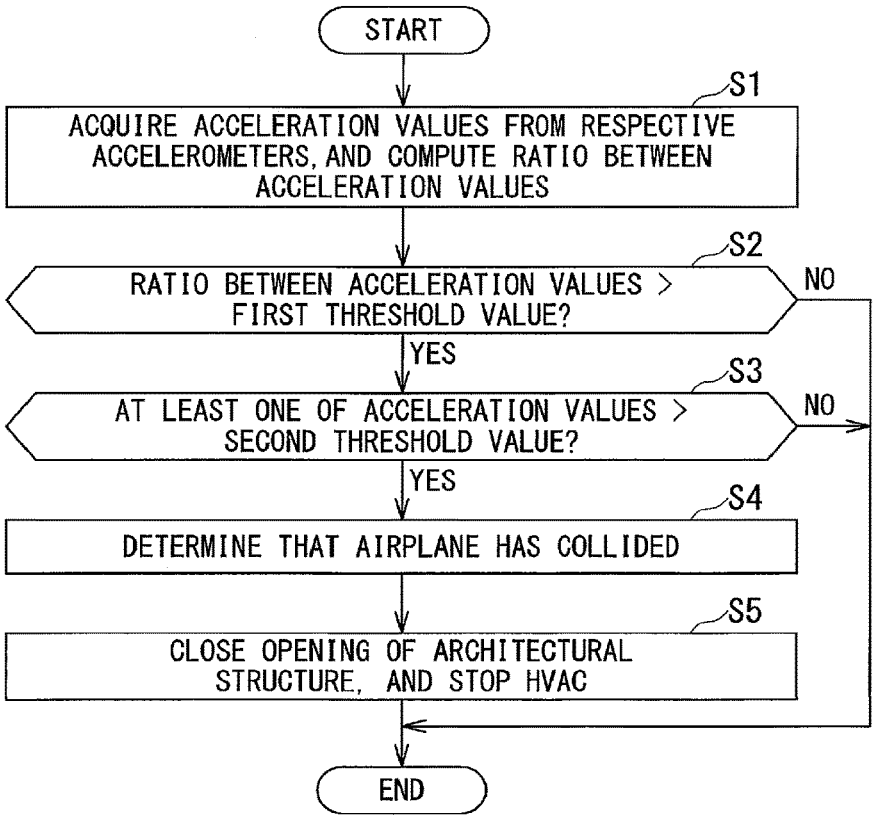
FIG. 3 is a flowchart illustrating a detection operation for collision of an airplane to be performed by a computer installed on the architectural structure shown in FIG. 1.

Next, a description will be given of a detection operation of the computer 24 for detecting collision of the airplane 15 against the architectural structure 10 by referring to the flowchart of FIG. 3.

First, in the step S1, the computer 24 acquires acceleration values measured by the respective accelerometers 23A, 23B, . . . installed on plural floors, and computes the ratio between the acceleration values.

In the next step S2, the computer 24 determines whether the ratio between the acceleration values computed in the step S1 exceeds the first threshold value or not.

When the computer 24 determines that the ratio between the acceleration values exceeds the first threshold value, in the next step S3, the computer 24 determines whether at least one of the acceleration values measured by the respective accelerometers 23A, 23B, . . . exceeds the second threshold value or not.

When the computer 24 determines that at least one of the acceleration values measured by the respective accelerometers 23A, 23B, . . . exceeds the second threshold value, in the next step S4, the computer 24 determines that the airplane 15 has collided against the architectural structure 10. In the next step S5, the computer 24 causes the respective closing apparatuses 21 to close all the openings 13 and further stops the HVAC systems 14 of the respective openings 13.

Since the first embodiment is configured as described above, the following effects (1) and (2) are obtained in the first embodiment.

(1) The computer 24 of the airplane-collision detecting apparatus 22 detects collision of the airplane 15 against the architectural structure 10, when the ratio between acceleration values measured by the respective accelerometers 23A, 23B, . . . exceeds the first threshold value and at least one of the acceleration values measured by the respective accelerometers 23A, 23B, . . . exceeds the second threshold value. Thus, it is possible to accurately and reliably detect collision of the airplane 15 against the architectural structure 10.

(2) The computer 24 of the airplane-collision detecting apparatus 22 stops all the HVAC systems 14 and causes the closing apparatuses 21 to operate such that all the openings 13 of the architectural structure 10 are closed, when detecting collision of the airplane 15 against the architectural structure 10. As a result, it is possible to infallibly prevent flame and blast from invading inside of the architectural structure 10 through its openings 13, which flame and blast are caused by collision of the airplane 15 against the architectural structure 10.

Depending on the type of the architectural structure 10, the computer 24 of the airplane-collision detecting apparatus 22 may detect collision of the airplane 15 against the architectural structure 10 by determining whether the ratio between acceleration values measured by the respective accelerometers 23A, 23B, exceeds the first threshold value or not, without comparing an acceleration value measured by at least one of the accelerometers 23A, 23B, . . . with the second threshold value.

Although a description has been given of the case where the closing apparatuses 21 are provided for the respective openings spatially connected with outside of the building in the above-described embodiment, the operation range of a detection apparatus may be changed such that the detection apparatus closes an opening between sections inside or between sections in the vertical direction. This point holds true for other embodiments described below.

[Second Embodiment (FIG. 1, FIG. 2)]

The second embodiment will be described by referring to FIG. 1. In the second embodiment, each of the components substantially equivalent to the corresponding components of the first embodiment is assigned with the same reference sign as that of the first embodiment, and duplicate description is omitted or shortened.

In the second embodiment, a closing facility 30 is provided as a facility for closing an opening of an architectural structure. This closing facility 30 differs from the closing facility 20 of the first embodiment in that a computer 32 of an airplane-collision detecting apparatus 31 detects collision of the airplane 15 (i.e., flying object) against the architectural structure 10 and its collision direction, closes the opening 13 existing in the collision direction, and stops the HVAC system 14 existing in the collision direction.

In other words, the computer 32 determines the collision direction of the airplane 15 by determining the ratio between acceleration components in the two horizontal directions (i.e., the x-direction and y-direction) of acceleration measured by at least one of the accelerometers 23A, 23B, . . . , after detecting collision of the airplane 15 against the architectural structure 10 in the same manner as the first embodiment. Here, the x-direction acceleration component is defined as Ax and the y-direction acceleration component is defined as Ay. For instance, the computer 32 determines that the airplane 15 has collided in the direction in parallel with the y-direction acceleration component, when the value of the ratio Ay/Ax is extremely larger than 1 (by several tens of times or more). Additionally, for instance, the computer 32 determines that the airplane 15 has collided in the direction in parallel with the x-direction acceleration component, when the value of the ratio Ay/Ax is extremely smaller than 1 (Ay/Ax is one over several tens or less). Further, for instance, the computer 32 determines that the airplane 15 has collided in the direction oblique to both of the x-direction acceleration component and the y-direction acceleration component, when the value of the ratio Ay/Ax is substantially equal to 1.

When detecting collision of the airplane 15 against the architectural structure 10 and its collision direction, the computer 32 closes the opening 13 existing in the collision direction of the airplane 15 out of all the openings 13 in the architectural structure 10 (e.g., closes the opening 13 existing on two wall-surfaces in the collision direction of the airplane 15 when the architectural structure 10 is a quadrangle in a plan view), by transmitting the operation command to the corresponding closing apparatus 21. At the same time, the computer 32 stops the HVAC system 14 installed in association with this opening 13 to be closed, by transmitting the stop command to this HVAC system 14.

Since the second embodiment is configured as described above, the same effects as the effects (1) and (2) of the first embodiment are also obtained in the second embodiment and the following effect (3) is further obtained in second embodiment.

(3) The computer 32 of the airplane-collision detecting apparatus 31 detects the collision direction of the airplane 15 against the architectural structure 10 by determining the ratio between two horizontal-direction acceleration components of acceleration (values) measured by at least one of the accelerometers 32A, 32B, . . . , causes the corresponding closing apparatus 21 to close the opening 13 which exists in the collision direction of the airplane 15 in the architectural structure 10, and stops the HVAC system 14 installed in association with this opening 13 to be closed. As a result, it is possible to keep each opening 13, which does not exist in the collision direction of the airplane 15, in the open state, and it is possible to keep each HVAC system 14, which is associated with each opening 13 to be kept in the open state, in the operating state. Thus, it is possible to maintain heating, ventilation, and air-conditioning of the architectural structure 10.

[Third Embodiment (FIG. 1, FIG. 2)]

The third embodiment will be described by referring to FIG. 1. In the third embodiment, each of the components substantially equivalent to the corresponding components of the first embodiment is assigned with the same reference sign as that of the first embodiment, and duplicate description is omitted or shortened.

In the third embodiment, a closing facility 40 is provided as a facility for closing an opening of an architectural structure. This closing facility 40 differs from the closing facility 20 of the first embodiment in that a computer 42 of an airplane-collision detecting apparatus 41 detects collision of the airplane 15 against the architectural structure 10 and its collision position (collision wall-surface), closes the opening 13 existing at the collision position, and stops the HVAC system 14 existing at the collision position. In this case, the computer 42 may detect the collision direction of the airplane 15 against the architectural structure 10 in addition to the collision position.

In other words, the computer 42 detects collision of the airplane 15 against the architectural structure 10 in the same manner as the first embodiment, and detects the collision direction of the airplane 15 against the architectural structure 10 depending on conditions. Afterward, the computer 42 detects the position (wall-surface) where the airplane 15 has collided, by determining positive/negative signs of the respective horizontal-direction acceleration components (i.e., the x-direction acceleration component and the y-direction acceleration component) of acceleration (values) measured by at least one of the accelerometers 23A, 23B, . . . .

For instance, the computer 42 assigns positive and negative signs to the respective two horizontal-direction acceleration components measured by the accelerometers 23A, 23B, . . . (e.g., positive sign is assigned to the orientation indicated by each arrow in FIG. 2). Further, when detecting collision of the airplane 15, the computer 42 determines which of the two horizontal-direction acceleration components has become larger in absolute value, and then determines that the airplane 15 has collided against the architectural structure 10 at the position (wall-surface) in the direction which is opposite to the direction defined by the sign of the horizontal-direction acceleration component determined to have become larger in absolute value.

When detecting collision of the airplane 15 against the architectural structure 10 and its collision position (collision wall-surface), the computer 42 closes the opening 13 existing at the collision position (collision wall-surface) of the airplane 15 out of all the openings 13 in the architectural structure 10, by transmitting the operation command to the corresponding closing apparatus 21. At the same time, the computer 32 stops the HVAC system 14 installed in association with this opening 13 to be closed, by transmitting the stop command to this HVAC system 14.

Since the third embodiment is configured as described above, the same effects as the effects (1) and (2) of the first embodiment are also obtained in the third embodiment and the following effect (4) is further obtained in third embodiment.

(4) The computer 42 of the airplane-collision detecting apparatus 41 detects the collision position (collision wall-surface) of the airplane 15 by discriminating signs of horizontal-direction acceleration components of acceleration measured by at least one of the accelerometer 23A, 23B, . . . , then causes the corresponding closing apparatus 21 to close the opening 13 existing at the collision position (collision wall-surface) of the airplane 15 in the architectural structure 10, and stops the HVAC system 14 installed in association with this opening 13 to be closed. As a result, it is possible to keep each opening 13, which does not exist in the collision position (collision wall-surface) of the airplane 15, in the open state, and it is possible to keep each HVAC system 14, which is associated with each opening 13 to be kept in the open state, in the operating state. Thus, it is possible to maintain heating, ventilation, and air-conditioning of the architectural structure 10.

[Fourth Embodiment (FIG. 4)]

Figure 4:
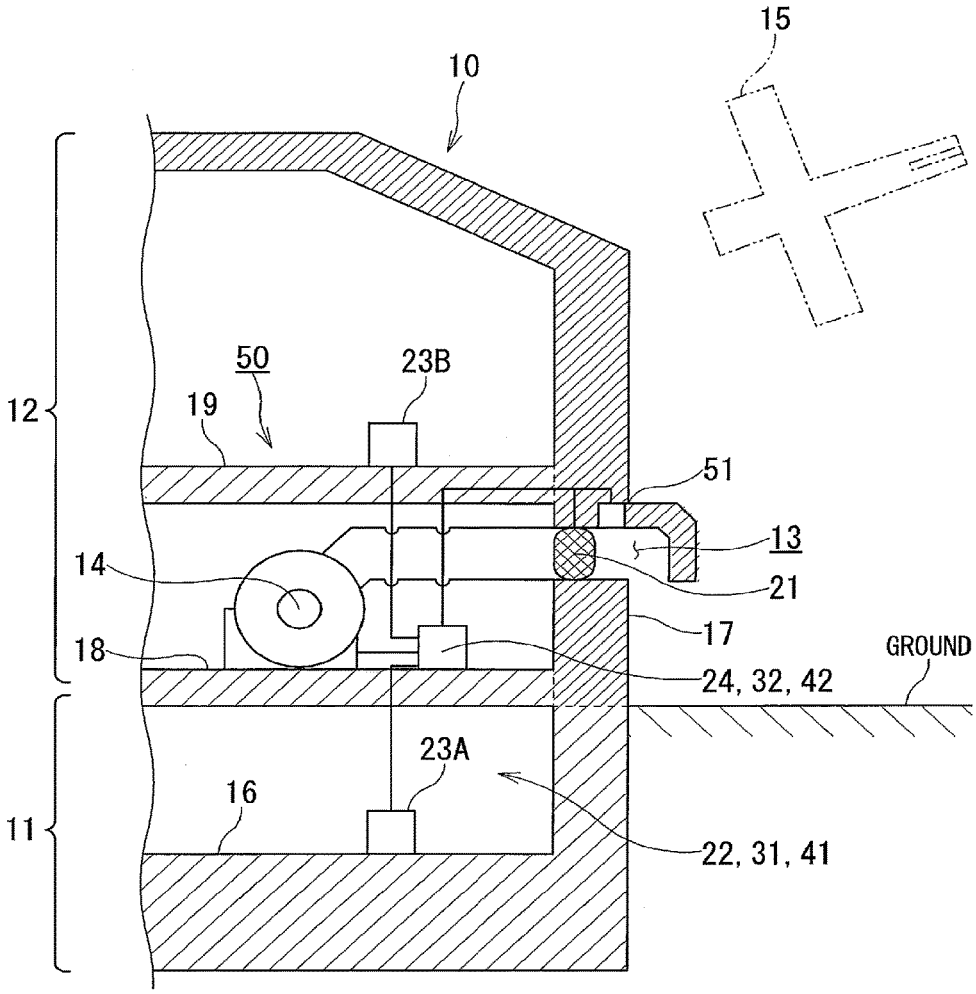
FIG. 4 is a configuration diagram illustrating a facility for closing an opening of an architectural structure in the fourth embodiment of the present invention together with this architectural structure.

FIG. 4 is a configuration diagram illustrating a facility for closing an opening of an architectural structure in the fourth embodiment of the present invention together with this architectural structure. In the fourth embodiment, each of the components substantially equivalent to the corresponding components of the first to third embodiments is assigned with the same reference sign as that of the first to third embodiments, and duplicate description is omitted or shortened.

In the fourth embodiment, a closing facility 50 is provided as a facility for closing an opening of an architectural structure. This closing facility 50 differs from the respective closing facilities 20, 30, 40 of the first to third embodiments in that the closing facility 50 includes the closing apparatuses 21, the airplane-collision detecting apparatus 22, 31, or 41, and a sensor 51 configured to detect temperature of flame and/or pressure of blast when the flame and blast caused at the time of collision of the airplane 15 against the architectural structure 10 invade the opening(s) 13 of the architectural structure 10.

In other words, the sensor 51 is installed outside the closing apparatus 21 in each opening 13 of the architectural structure 10, and is electrically connected to this closing apparatus 21. Further, the sensor 51 is electrically connected to the computer 24 of the airplane-collision detecting apparatus 22, the computer 32 of the airplane-collision detecting apparatus 31, or the computer 42 of the airplane-collision detecting apparatus 41.

The sensor 51 detects temperature of flame generated at the time of collision of the airplane 15 against the architectural structure 10, and transmits the operation command to the near closing apparatus 21 for causing this closing apparatus 21 to close the opening 13 equipped with this sensor 51 when the detected temperature exceeds a predetermined temperature. In this case, the sensor 51 acts in such a manner that the opening 13 is closed prior to transmission of the operation command from the computer 24, 32, or 42 to the closing apparatus 21.

Additionally or alternatively, the sensor 51 detects pressure of blast generated at the time of collision of the airplane 15 against the architectural structure 10, and transmits the operation command to the near closing apparatus 21 for causing this closing apparatus 21 to close the opening 13 equipped with this sensor 51 when the detected pressure exceeds a predetermined pressure. In this case, the sensor 51 acts in such a manner that the opening 13 is closed prior to transmission of the operation command from the computer 24, 32, or 42 to the closing apparatus 21.

When the detected temperature or the detected pressure exceeds a predetermined value as described above, the sensor 51 transmits a signal to the computer 24, 32, or 42 in such a manner that the computer 24, 32, or 42 stops the HVAC system. 14 installed in association with the opening 13 to be closed by transmitting the stop signal to this HVAC system 14.

Since the fourth embodiment is configured as described above, the same effects as the effects (1) and (2) of the first embodiment are also obtained in the fourth embodiment and the following effect (5) is further obtained in fourth embodiment.

(5) The sensor 51 installed on the opening 13 of the architectural structure 10 detects temperature of flame or pressure of blast generated by collision of the airplane 15 against the architectural structure 10, and transmits the operation command to the closing apparatus 21 for causing the closing apparatus 21 to rapidly close the opening 13 equipped with this sensor 51 before transmission of the operation command from the computer 24, 32, or 42 of the airplane-collision detecting apparatus 22, 31, or 41 to the closing apparatus 21 when the detected temperature/pressure exceeds the predetermined pressure. Thus, it is possible to rapidly and infallibly prevent flame and blast from invading inside of the architectural structure 10 through the opening 13, which flame and blast are generated by collision of the airplane 15 against the architectural structure 10.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

REFERENCE SIGNS

10 architectural structure
13 opening
14 HVAC system
15 airplane (flying object)
20 closing facility (facility for closing an opening of an architectural structure)
21 closing apparatus (blocking means)
22 airplane-collision detecting apparatus (detection apparatus for collision of an airplane against an architectural structure)
23A, 23B, . . . accelerometer
24 computer (computation means)
30 closing facility (facility for closing an opening of an architectural structure)
31 airplane-collision detecting apparatus (detection apparatus for collision of an airplane against an architectural structure)
32 computer (computation means)
40 closing facility (facility for closing an opening of an architectural structure)
41 airplane-collision detecting apparatus (detection apparatus for collision of an airplane against an architectural structure)
42 computer (computation means)
50 closing facility (facility for closing an opening of an architectural structure)
51 sensor

The invention claimed is:

1. A detection method for collision of a flying object against an architectural structure, the detection method comprising:

installing a plurality of accelerometers on respective positions of the architectural structure which are different in height from each other;

causing each of the plurality of accelerometers to measure an acceleration value generated in the architectural structure; and detecting collision of the flying object against the architectural structure when a ratio between acceleration values measured by the plurality of accelerometers exceeds a first threshold value.

2. The detection method for collision of a flying object against an architectural structure according to claim 1, wherein the collision of a flying object is detected, when the ratio between acceleration values exceeds the first threshold value and an acceleration value measured by at least one of the plurality of accelerometers exceeds a second threshold value.

3. The detection method for collision of a flying object against an architectural structure according to claim 1, further detecting a collision direction of the flying object by determining a ratio between two horizontal-direction acceleration components of an acceleration value measured by at least one of the plurality of accelerometers.

4. The detection method for collision of a flying object against an architectural structure according to claim 1, further detecting a position where the flying object has collided against the architectural structure, by discriminating a sign of each horizontal-direction acceleration component of an acceleration value measured by at least one of the plurality of accelerometers.

5. A detection apparatus for collision of a flying object against an architectural structure, the detection apparatus comprising:

a plurality of accelerometers configured to be installed on respective positions of the architectural structure which are different in height from each other, and separately measure an acceleration value generated in the architectural structure; and a computer configured to be electrically connected to the plurality of accelerometers, perform computation by using acceleration values measured by the plurality of accelerometers, and detect collision of the flying object against the architectural structure when a ratio between the acceleration values measured by the plurality of accelerometers exceeds a first threshold value.

6. The detection apparatus for collision of a flying object against an architectural structure according to claim 5, wherein the computer is configured to detect the collision of a flying object against the architectural structure, when the ratio between the acceleration values exceeds the first threshold value and an acceleration value measured by at least one of the plurality of accelerometers exceeds a second threshold value.

7. The detection apparatus for collision of a flying object against an architectural structure according to claim 5, wherein the computer is configured to detect a collision direction of the flying object by determining a ratio between two horizontal-direction acceleration components of an acceleration value measured by at least one of the plurality of accelerometers.

8. The detection apparatus for collision of a flying object against an architectural structure according to claim 5, wherein the computer is configured to detect a position where the flying object has collided against the architectural structure, by discriminating a sign of each horizontal-direction acceleration component of an acceleration value measured by at least one of the plurality of accelerometers.

9. A facility for closing at least one of plural openings of an architectural structure, the facility comprising:

a closing apparatus configured to close at least one of plural openings; and the detection apparatus for collision of a flying object against an architectural structure according to claim 5, wherein the computer of the detection apparatus is configured to cause the closing apparatus to close at least one opening, when the computer detects collision of the flying object.

10. A facility for closing at least one of plural openings of an architectural structure, the facility comprising:

a closing apparatus configured to close at least one of plural openings; and the detection apparatus for collision of a flying object against an architectural structure according to claim 7, wherein the computer of the detection apparatus is configured to cause the closing apparatus to close an opening existing in a collision direction of the flying object, when the computer detects the collision direction of the flying object.

11. A facility for closing at least one of plural openings of an architectural structure, the facility comprising:

a closing apparatus configured to close at least one of plural openings; and the detection apparatus for collision of a flying object against an architectural structure according to claim 8, wherein the computer of the detection apparatus is configured to cause the closing apparatus to close an opening existing at a collision position of the flying object, when the computer detects the collision position of the flying object.

12. A facility for closing at least one of plural openings of an architectural structure, the facility comprising:

a closing apparatus configured to close at least one of plural openings;

the detection apparatus for collision of a flying object against an architectural structure according to claim 5; and a sensor configured to be installed on an opening and detect temperature of flame or pressure of blast invading into an opening on which the sensor is installed;

wherein the sensor is configured to cause the closing apparatus to close the opening on which the sensor is installed prior to transmission of an operation command from the detection apparatus to the closing apparatus, when a detection value detected by the sensor exceeds a predetermined value.

13. A facility for closing at least one of plural openings of an architectural structure, the facility comprising:

a closing apparatus configured to close at least one of plural openings; and a collision detection apparatus configured to detect collision of a colliding object against the architectural structure, wherein the collision detection apparatus includes a computer configured to cause the closing apparatus to close at least one of plural openings when the computer detects collision of the colliding object.

14. A facility for closing at least one of plural openings of an architectural structure, the facility comprising:

a closing apparatus configured to close at least one of plural openings; and a collision detection apparatus configured to detect collision of a colliding object against the architectural structure, wherein the collision detection apparatus includes a computer configured to cause the closing apparatus to close an opening existing in a collision direction of the colliding object when the computer detects the collision direction of the colliding object.

15. A facility for closing at least one of plural openings of an architectural structure, the facility comprising:

a closing apparatus configured to close at least one of plural openings; and a collision detection apparatus configured to detect collision of a colliding object against the architectural structure, wherein the collision detection apparatus includes a computer configured to cause the closing apparatus to close an opening existing at a collision position of the colliding object when the computer detects the collision position of the colliding object.

* * * * *